US007025656B2

(12) United States Patent
Bailey

(10) Patent No.: US 7,025,656 B2
(45) Date of Patent: Apr. 11, 2006

(54) TOY TUBE VEHICLE RACER APPARATUS

(76) Inventor: Robert J Bailey, P. O. Box 423, Winsted, CT (US) 06098

( * ) Notice: Subject to any disclaimer, the term of this patent is extended or adjusted under 35 U.S.C. 154(b) by 0 days.

(21) Appl. No.: 10/858,085

(22) Filed: May 31, 2004

(65) Prior Publication Data

US 2005/0266768 A1 Dec. 1, 2005

(51) Int. Cl.
*A63H 18/00* (2006.01)

(52) U.S. Cl. ..... 446/444; 104/138.1

(58) Field of Classification Search ..... 446/168–174, 446/444, 89; 238/10 A–10 F, 134; 104/138.1, 104/138.2, 53
See application file for complete search history.

(56) References Cited

U.S. PATENT DOCUMENTS 3,590,522 A * 7/1971 Hamano ..... 104/138.1
3,669,026 A * 6/1972 Mouritzen ..... 104/138.1
3,774,547 A * 11/1973 Widiger et al. ..... 238/134
4,231,294 A * 11/1980 Arzoumanian ..... 104/138.1
4,642,063 A * 2/1987 Gillette ..... 446/94
4,652,248 A * 3/1987 Kozuka ..... 446/444
5,507,679 A * 4/1996 Getsay ..... 446/444
D397,742 S * 9/1998 Jensen ..... D21/484
6,273,778 B1 * 8/2001 Kyster ..... 446/168
6,402,581 B1 * 6/2002 Podgaiz ..... 446/107
2002/0182974 A1 * 12/2002 Grabianski ..... 446/93

FOREIGN PATENT DOCUMENTS

GB 2043472 A * 10/1980

* cited by examiner

*Primary Examiner*—Kien Nguyen
(74) *Attorney, Agent, or Firm*—The Miller Law Offices, PLC; Steven J. Miller, Esq.

(57) ABSTRACT

An apparatus for allowing an individual to simply assemble a transparent cylindrical conduit sectioned track system which guides a self propelled toy vehicle through this track system. A self propelled toy vehicle designed to run securely through transparent cylindrical conduit track prohibiting the toy vehicle from falling off of the track, an easy to assemble the transparent cylindrical sections, and an interlocking structure to ensure the fitting of the track sections are secure enough to remain intact for normal use. A portable means for an individual to carry said self-propelled toy vehicle and the various shaped transparent cylindrical track sections.

17 Claims, 6 Drawing Sheets

TOY TUBE VEHICLE RACER APPARATUS

CROSS REFERENCE TO RELATED APPLICATIONS

Prior application Ser. No.: 07/962,707 (abandoned—never published—not claiming benefit of its prior filing date).

STATEMENT REGARDING FEDERALLY SPONSORED RESEARCH OR DEVELOPMENT

Not Applicable

DESCRIPTION OF ATTACHED APPENDIX

Not Applicable

BACKGROUND OF THE INVENTION

This invention relates generally to the field of electromechanical toys for individuals ages 6 years to 12 years and more specifically to an apparatus for allowing said individual to simply assemble a transparent cylindrical conduit sectioned track system which guides a self propelled toy vehicle through this track system. The invention also includes a means for said individual to physically carry said track system and said vehicle to different geographic locations.

Toy race vehicle track systems have been used and enjoyed by individuals for a long time. There were several types of systems. One type consisted of an inclined flat track assembly, with machined guiding slots for a non-powered toy vehicle. The vehicle would be placed at the top of the straight inclined track, and then let go to speed down the track. Another type, consisted of non-inclined flat assembled interlocking track sections, also with machined slots, but for an externally powered electric toy vehicle, which could traverse a flat winding track system.

The prior technology consisted of track systems with flat sections that could be assembled through some interlocking device, which often required adult assistance. The flat sections traditionally would have one or more machined slots in the track which were intended to guide the toy vehicle around the assembled track system. The prior art also has cylindical tubular sections similar to the current invention, however, these cylindrical tubular sections required installed rails inside said cylindrical tubes, in order to provide external power to said vehicles and thereby constraining the rotational movement of the toy vehicle to said rail (See U.S. Pat. No. 5,507,679; Getsay). The present invention does not require said rails for powering the toy vehicle, thereby eliminating the toy vehicles rotational constraints and allowing the vehicle absolute freedom to rotate while travelling through the cylindrical tubular track system. The present invention has a unique wheel arrangement, wherein the plane of the various sets of wheels around the periphery of the vehicle are geometrically spaced 12*o* angular degrees apart, thereby allowing the toy vehicle stable freedom to rotate while travelling through the cylindrical tube track system. The prior art does not contain these unique features. In the prior art, the toy race vehicles were usually electrically powered by and external transformer device. Another arrangement consisted of an assembled transparent tube system, powering the toy vehicle by injecting a high velocity fluid into the track system. The problem with the assembled flat track system was that as a user tried to speed the toy race vehicle up, inevitably the toy vehicle would leave the track system when encountering a curve or turn in the track system, thereby frustrating the child playing with the system. The problem with the fluid drive cylindrical track system, was that the joints between track sections could never be made sufficiently secure to inhibit driving fluid loss and at the same time allow flexibility and choice of geometric track assemblies by the user. The invention herein is also an improvement on earlier similar designs by this inventor in that this invention improves the vehicle wheel arrangement and also this invention has improved cylindrical track section geometries.

BRIEF SUMMARY OF THE INVENTION

The primary object of the invention is to provide a better self propelled toy vehicle track system that prohibits the vehicle from falling off of the track.

Another object of the invention is to provide a quick and easy method for assembling a toy vehicle track system.

Another object of the invention is to provide a transparent closed toy vehicle track system to allow a child to view the toy vehicle.

A further object of the invention is to provide a toy vehicle track system that allows numerous different three dimensional assembled track configurations.

Another object of the invention is to provide options for selecting different power drive mechanisms for the toy vehicle.

Another object of the invention is to provide a transparent closed toy track system which requires no external power and thereby allowing system mobility and unlimited location options.

Another object of the invention is to provide a transparent closed toy track system which requires no vehicle rail system, thereby allowing the toy vehicles complete rotational freedom and enhance the entertainment experience of the user.

Another object of the invention is to provide for easy transportability by a single individual.

Other objects and advantages of the present invention will become apparent from the following descriptions, taken in connection with the accompanying drawings, wherein, by way of illustration and example, an embodiment of the present invention is disclosed.

In accordance with a preferred embodiment of the invention, there is disclosed an apparatus for allowing a child to simply assemble a transparent cylindrical conduit sectioned track system which guides a self propelled toy vehicle through this track system comprising a self propelled toy vehicle designed run securely through transparent cylindrical tubular track system prohibiting the toy vehicle from falling off of the track, a unique peripheral placement of the toy vehicles wheels to allow rotational independence from the constraints of any rail system which is then not required, an easy means to assemble the transparent cylindrical sections, and a means to ensure to the fitting of the track sections are secure enough to remain intact for normal use.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

Figure 1:
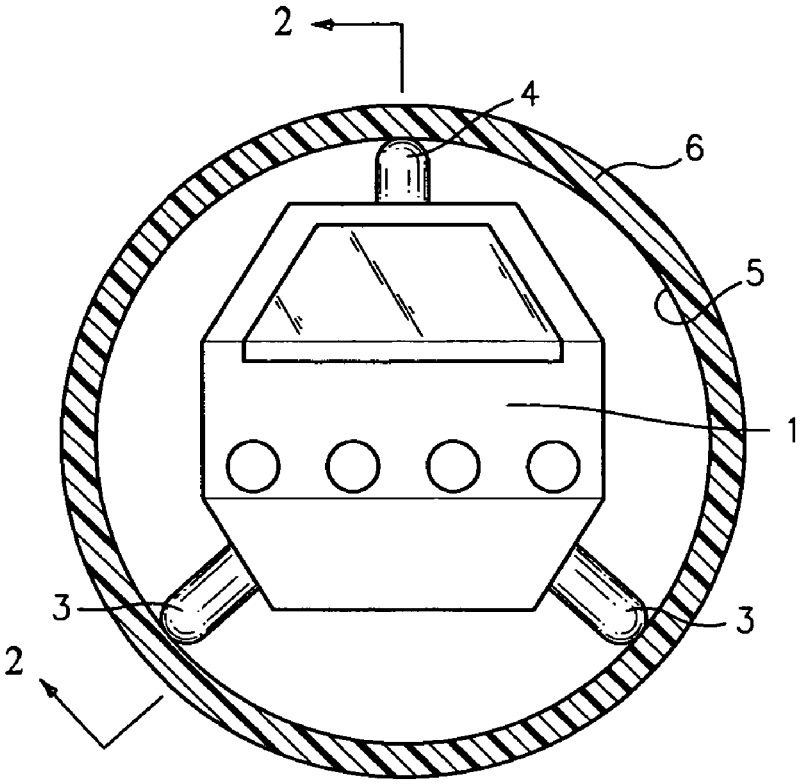
FIG. 1 is a cross sectional view of the self propelled toy vehicle within a particular section of transparent cylindrical track tubing, illustrating the 120 degree angular separation of the operating planes of the peripheral wheels.

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner. Turning first to FIG. 1, there is shown the toy vehicle (1) which is powered by an internal motor assembly containing a drive mechanism and a power source, the motor assembly and its components are internal to said toy vehicle and are not shown. Typical drive mechanisms include function, chain, belt, or gear devices, and typical power sources include battery or spring wound assemblies. The motor assembly drives one or more drive wheels (2). Additional free-wheeling wheels (3) provide support and stability to the toy vehicle. As shown in FIG. 1, the wheels (2) and (3) when compared to the wheels (4), are each individually located in planes that are geometrically oriented in such a manner as to be angularly spaced 120 degrees apart. This allows a far more stable configuration than if the wheels were all placed vertically in planes that were parallel to one another, as is the case in the prior art. In combination, generally, one drive wheel (2) and three other free wheeling wheels (3) are used. However, it is to be noted that the combination of these four wheels [(2) and (3)] may be set up in any combination of wherein a minimum of one of the wheels is a drive wheel and a maximum of four wheels are drive wheels. The number of the four wheels [(2(and (3)] not chosen to apply power are then necessarily free-wheeling wheels. These wheels, (2) and (3), support the bottom of the vehicle inside the curved inner surface (5) of the transparent cylindrical track (6). Positioned at the top of the self-propelled toy vehicle, is a free-wheeling-top-wheel assembly called a spring-loaded wheel herein (4), which is connected to the self-propelled toy vehicle (1) by an internal spring mechanism not shown, and which is designed to force the spring loaded wheel (4), in an upward direction against the inner surface (5) of the transparent track assemblies, which in turn provides an equal and opposite force to the self-propelled toy vehicle (1) on the drive (2) and free wheeling (3) wheels, against the opposite inner surface (5). Said spring loaded wheel (4) also serves to "turn-on" and "turn-off" the toy vehicle drive wheel system. A mechanical stop is provided to ensure that the spring mechanism does not extend beyond the spring loaded wheel assembly too far out of the top of the self propelled toy vehicle. The characteristics of the spring mechanism are selected to provide sufficient pressure to maintain drive wheel (2) contact against the inner surface of the track, but not too much pressure to stall the motor assembly. The material of the track is selected to be completely transparent and the thickness of the cylinder walls creates a rigid yet slightly elastic tube (6). Each track section of user chosen shape can be interlocked into one another in a manner that allows for a secure connection and smooth interior at the inner surface, thereby allowing the toy race vehicle to traverse the joints unencumbered. The interlocking track section arrangement, while adequately secure once assembled, nonetheless allows for easy disassembly.

Figure 2:
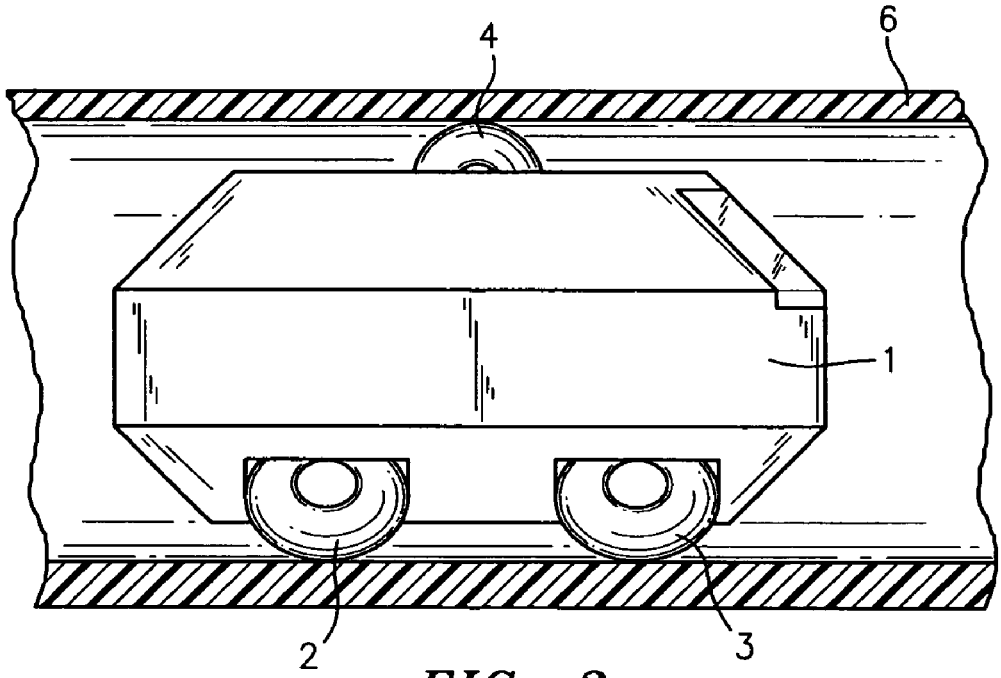
FIG. 2 is a elevation view of the self propelled toy vehicle within a particular section of transparent cylindrical track tubing, further illustrating the angular peripheral wheel arrangement.
Figure 3:
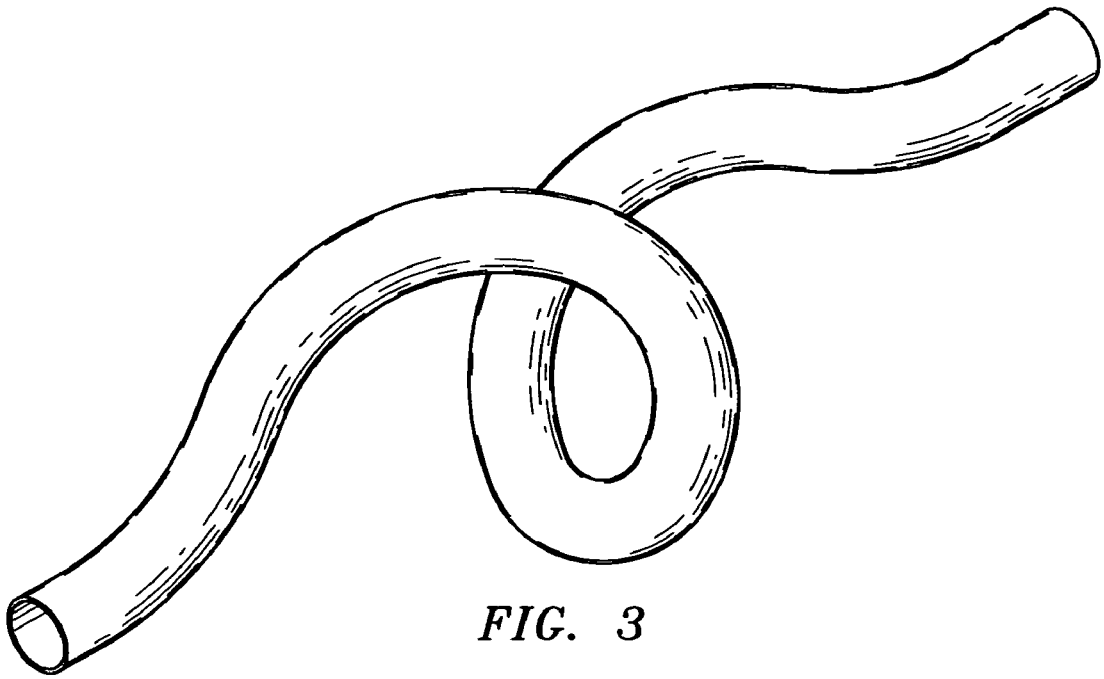
FIG. 3 is a perspective view of a single cylindrical vertical loop track section which may be selected by a user in the assembly of a track system.
Figure 4:
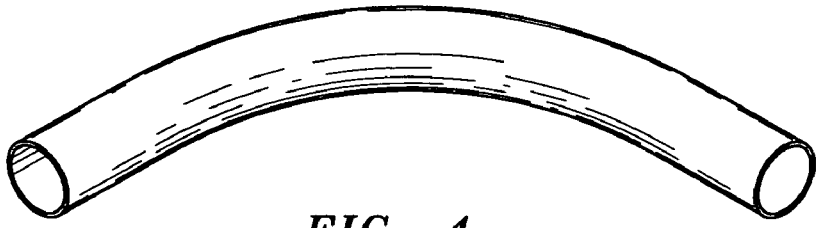
FIG. 4 is a perspective view of a cylindrical 90 degree curved turn track section which may be selected by a user in the assembly of a track system.
Figure 5:
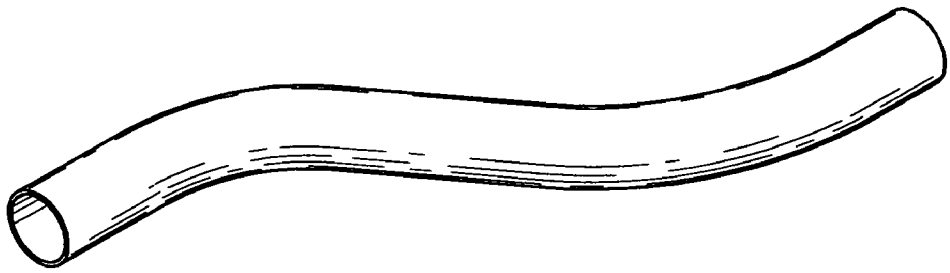
FIG. 5 is a perspective cut-away view of an "S" shaped curved section of the transparent cylindrical track tubing.
Figure 6:
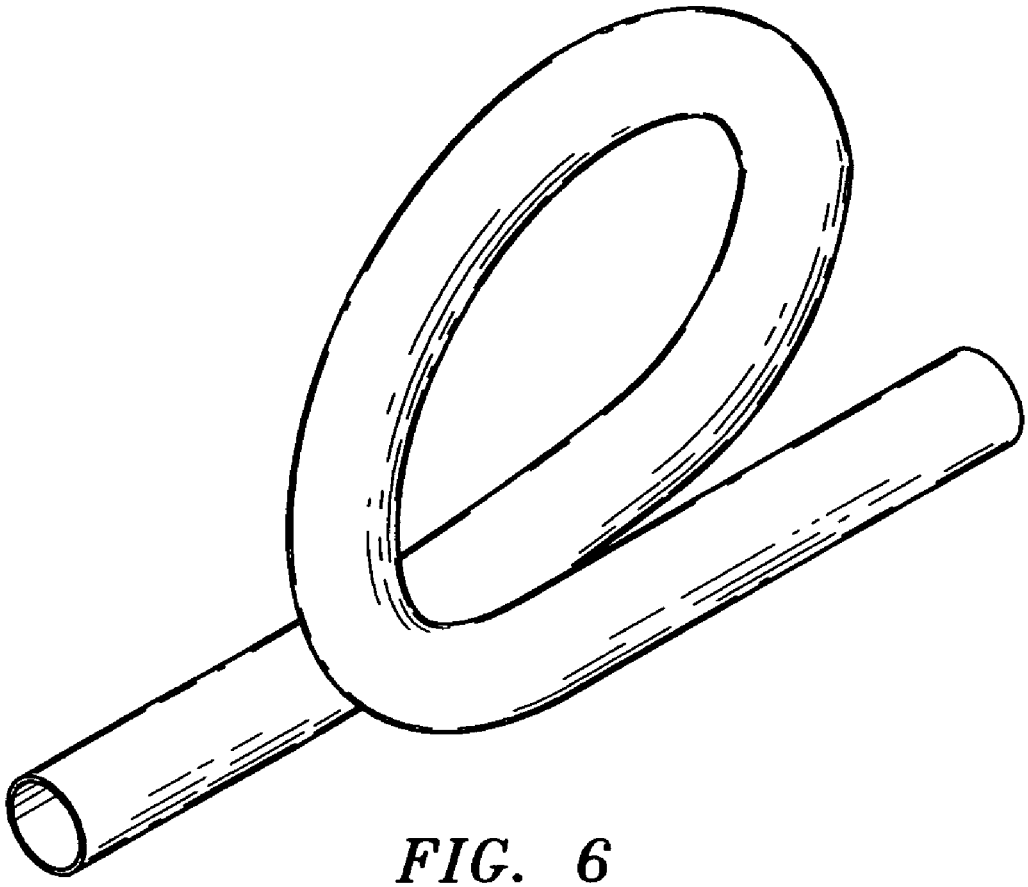
FIG. 6 is a perspective view of a loop shaped curved section of the transparent cylindrical track tubing.
Figure 7:
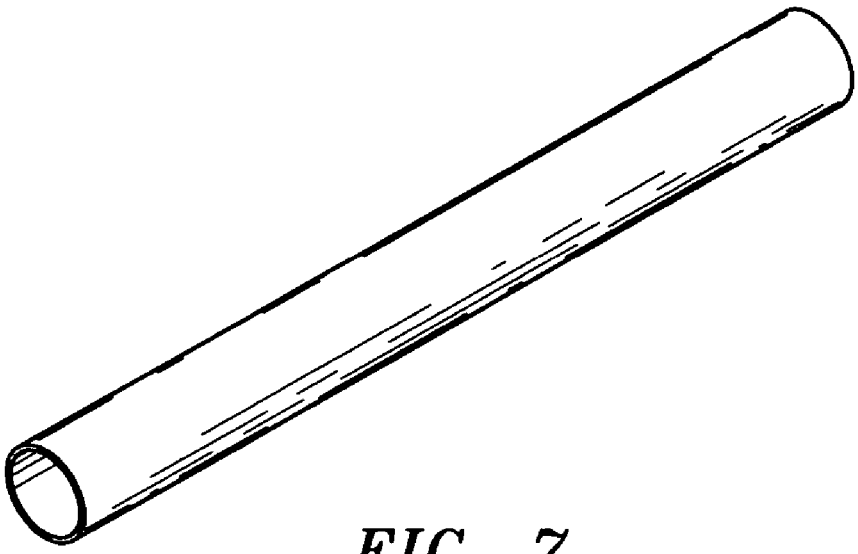
FIG. 7 is a perspective view of a straight shaped section of the transparent cylindrical track tubing.
Figure 8:
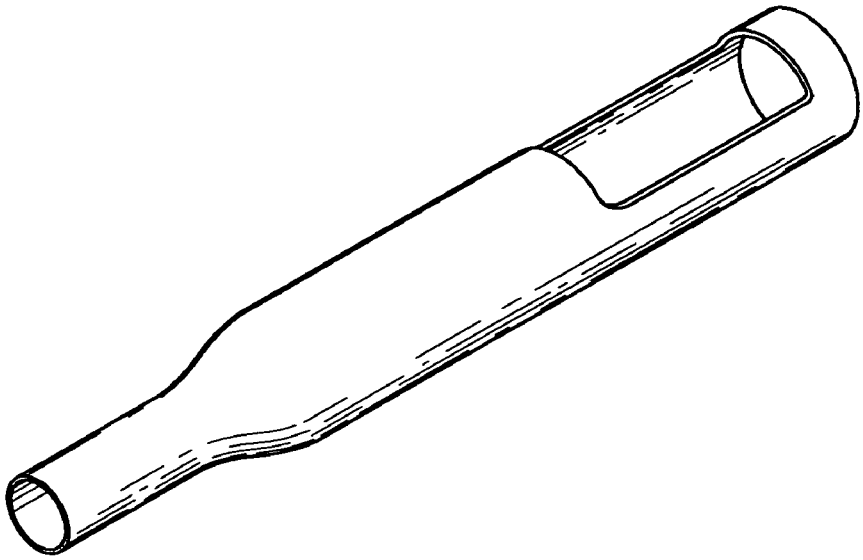
FIG. 8 is a perspective view of a diameter reducing shaped section with a piece removed from its outer surface periphery of the transparent cylindrical track tubing.
Figure 9:
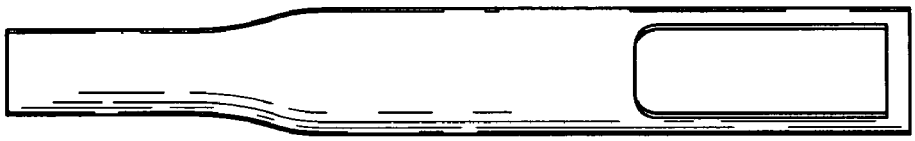
FIG. 9 is a plan view of a diameter reducing shaped section with a piece removed from its outer surface periphery of the transparent cylindrical track tubing.
Figure 10:
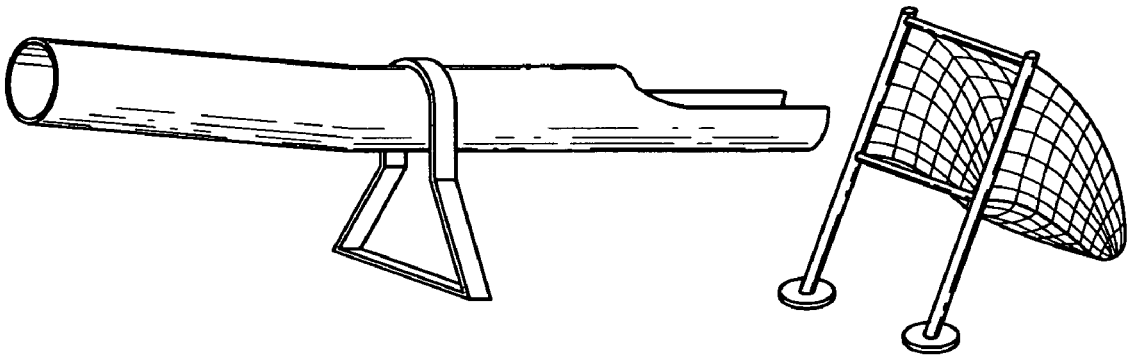
FIG. 10 is a perspective view of a slightly curved shaped section and a catch net, with a piece removed from the cylindrical tube's outer surface periphery at one end of the transparent cylindrical track tubing, and illustrating how a toy race vehicle would be caught at the end of its traverse though a user selected track system arrangement.
Figure 11:
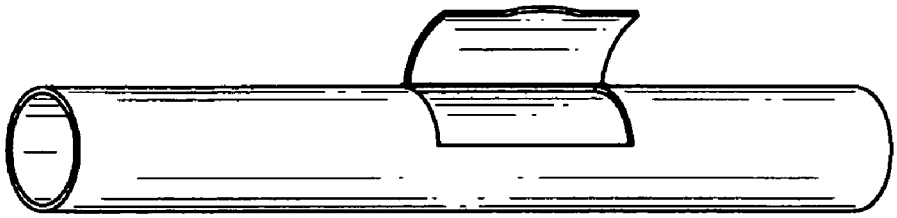
FIG. 11 is a perspective view of a straight shaped section with a piece cut from its outer surface periphery of the transparent cylindrical track tubing, where said cut piece remains attached in a hinge-like fashion so as to be able to open and close.
Figure 12:
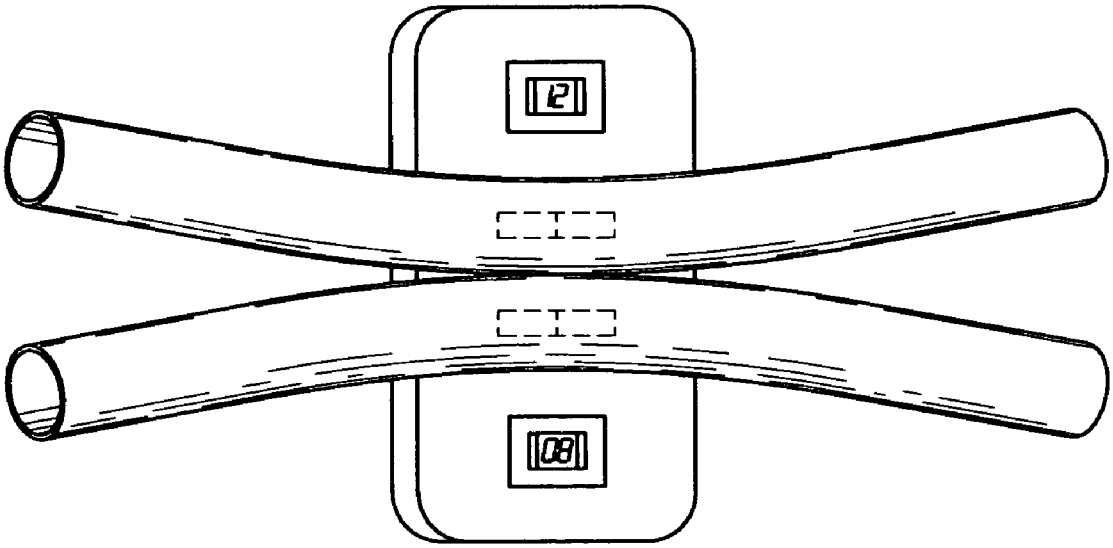
FIG. 12 is a perspective view of a slightly curved shaped adjacent double-tube transparent tube track section with a lap counter for each adjacent cylindrical tube which may be selected by the user in the assembly of a track system.
Figure 13:
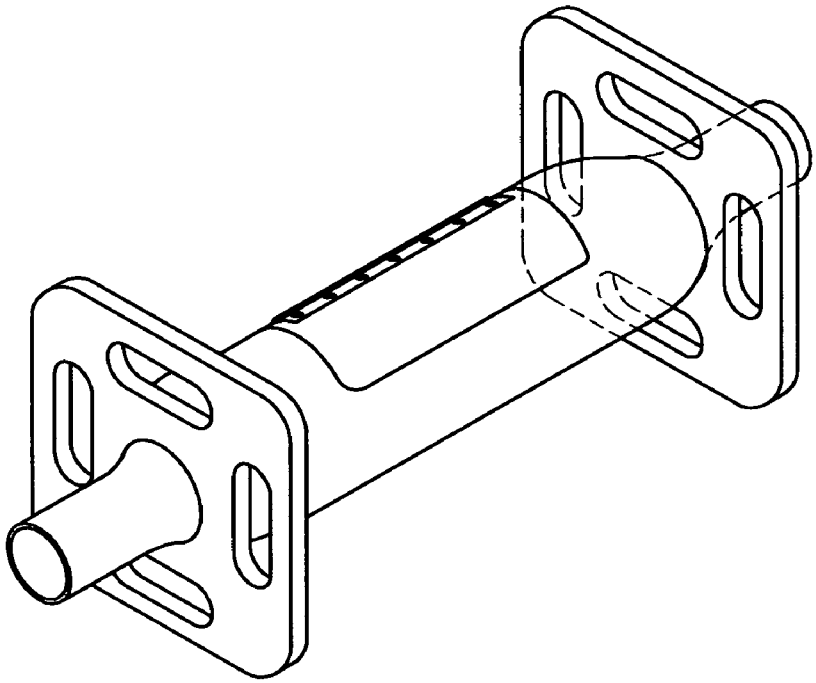
FIG. 13 is a perspective view of a "start-stop" tube section with ends of changing diameter, with supporting end flanges and with a piece cut from its outer surface periphery of the transparent cylindrical track tubing, where said cut piece remains attached in a hinge-like fashion so as to be able to open and close.
Figure 14:
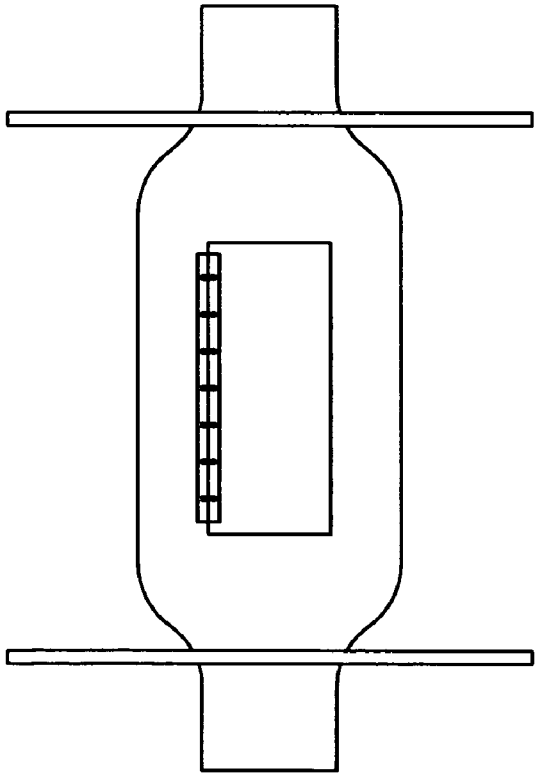
FIG. 14 is a plan view of said "start-stop" tube section illustrating the hinge spring loaded transparent cylindrical tube access door for inserting and removing the toy vehicle.

In operation, a user fits and assembles the transparent cylindrical sections of track together to form a course, then starts the toy vehicle motor, then inserts the vehicle into a pre-selected and assembled track system, then releases the toy vehicle and observes the vehicle traverse the assembled track arrangement. Referring to FIGS. 3 through 12, incl., the cylindrical track sections can be manufactured into various shapes. This invention contemplates a combination of any tubular transparent track shapes, which when assembled will have a fairly smooth inside diameter for said toy vehicle to traverse. Referring to FIGS. 1 and 2, the preferred embodiment of this invention depicts a leaf spring used to bias the top wheel assembly against the inner surface of the track, however, the invention contemplates the use of any spring type or variable pressure means.

The invention contemplates that the toy vehicle can be made in virtually any type or shape, and may even depict animals or other objects, as long as the geometry and construction of the chosen vehicle can properly traverse the internal tubular cylindrical geometric structure of the track system arrangement.

While the invention has been described in connection with a preferred embodiment, it is not intended to limit the scope of the invention to the particular form set forth, including, but not limited to the selection and use of the number, type and function of the various vehicle wheels, but on the contrary, it is intended to cover such alternatives, modifications, and equivalents as may be included within the spirit and scope of the invention as defined by the appended claims.

What is claimed is:

1. An apparatus for allowing the assembly of transparent cylindrical sections of varying geometric shapes combined with a self-propelled toy vehicle comprising:

A plurality of transparent cylindrical sections some of which being fabricated into different geometric shapes;

A means provided for assembling said various geometric shapes of said cylindrical sections to a complete assembly;

A self-propelled toy vehicle having a plurality of wheels positioned on its outer periphery, wherein at least one of said wheels is used to drive said self-propelled toy vehicle, and wherein at least one of the remaining wheels is spring loaded and is used to engage a switch to activate the power to the self-propelled toy vehicle's drive wheel;

Said plurality of wheels are each individually located in planes that are geometrically oriented in such a manner as to be angularly spaced 120 degrees apart;

Said cylindrical sections of varying shapes being assembled by an individual into a chosen arrangement thereby allowing the individual to place said self-propelled toy vehicle into said cylindrical sections' assembly and thereby permitting the viewing of said self propelled toy vehicles traversing said individually chosen cylindrical sections' arrangement.

2. An apparatus as in claim 1 in which the cylindrical sections of varying geometric shapes are fabricated of a transparent material.

3. An apparatus as in claim 1 in which the self-propelled toy vehicle has one drive wheel, three free-wheeling wheels, and one spring loaded wheel for starting and stopping the self-propelled toy vehicle, all located around the self-propelled toy vehicle's outer periphery.

4. An apparatus as in claim 1 in which the self-propelled toy vehicle has two drive wheels, two free-wheeling wheels, and one spring loaded wheel for starting and stopping the self-propelled toy vehicle, all located around the self-propelled toy vehicle's outer periphery.

5. An apparatus as in claim 1 in which the self-propelled toy vehicle has three drive wheels, one free-wheeling wheel, and one spring loaded wheel for starting and stopping the self-propelled toy vehicle, all located around the self-propelled toy vehicle's outer periphery.

6. An apparatus as in claim 1 in which the self-propelled toy vehicle has one drive wheel, three free-wheeling wheels, and one spring loaded wheel for starting and stopping the self-propelled toy vehicle, all located around the self-propelled toy vehicle's outer periphery.

7. An apparatus as in claim 1 in which the self-propelled toy vehicle has more than one drive wheel, more than one free-wheeling wheels, and more than one spring loaded wheel for starting and stopping the self-propelled toy vehicle, all located around the self-propelled toy vehicle's outer periphery.

8. An apparatus as in claim 1 in which the self propelled toy vehicle's body is fabricated of a transparent material.

9. An apparatus as in claim 1 in which one cylindrical geometric shape is straight section.

10. An apparatus as in claim 1 in which one cylindrical tube section's geometric shape is an "S" type turn.

11. An apparatus as in claim 1 in which one cylindrical tube section's geometric shape is a loop type turn.

12. An apparatus as in claim 1 in which one cylindrical tube section's geometric shape is a "U" bend type turn.

13. An apparatus as in claim 1 in which one cylindrical tube section's geometric shape is a 90 degree angle type turn.

14. An apparatus as in claim 1 in which one cylindrical tube section's geometric shape comprises a slightly curved shaped adjacent double-tube transparent plastic tube track section with a lap counter for each adjacent cylindrical tube.

15. An apparatus as in claim 1 in which the self-propelled toy vehicle is propelled by a battery powered electric motor.

16. An apparatus as in claim 1 in which the self-propelled toy vehicle is powered by a wound spring stored energy device.

17. An apparatus as in claim 1 in which the self-propelled toy vehicle possesses battery powered lights.

* * * * *